United States Patent [19]

Schmidt

[11] Patent Number: 4,537,589

[45] Date of Patent: Aug. 27, 1985

[54] APPARATUS FOR REMOVING THE WASTE EDGE PIECES FROM PUNCHED BLANKS

[75] Inventor: Heinrich Schmidt, Porta Westfalica, Fed. Rep. of Germany

[73] Assignee: Heinrich Greve GmbH, Lubbecke, Fed. Rep. of Germany

[21] Appl. No.: 439,640

[22] Filed: Nov. 5, 1982

[30] Foreign Application Priority Data

Nov. 6, 1981 [DE] Fed. Rep. of Germany ..... 3144125

[51] Int. Cl.[3] ..... B31B 49/00

[52] U.S. Cl. ..... 493/373; 83/159

[58] Field of Search ..... 493/373; 225/106, 103; 83/159, 150

[56] References Cited

U.S. PATENT DOCUMENTS

| | | | |
|---|---|---|---|
| 2,589,033 | 3/1952 | Baumgartner | 83/159 |
| 4,108,032 | 8/1978 | Scheib et al. | 83/159 |
| 4,410,315 | 10/1983 | Frye | 493/373 |

FOREIGN PATENT DOCUMENTS

| | | | |
|---|---|---|---|
| 718649 | 9/1965 | Canada | 493/373 |

*Primary Examiner*—Leon Gilden

[57] ABSTRACT

Waste edge pieces are separated from punched blanks, especially cardboard box blanks, by puncturing to engage followed by outward pulling. The puncturing action is performed by a pawl, having a serrated edge, which is driven in an orbital motion.

13 Claims, 4 Drawing Figures

APPARATUS FOR REMOVING THE WASTE EDGE PIECES FROM PUNCHED BLANKS

BACKGROUND OF THE INVENTION (1.) Field of the Invention

The present invention relates to the processing of sheet material and particularly to the removal of waste edges from punched paper board blanks which have been stacked. More particularly, this invention is direct to apparatus for removing waste edge pieces which have been at least partly severed by stamping or punching blanks from sheet material and especially to such apparatus which is movable relative to stacks of such blanks to remove the waste edges sucessively layer-to-layer. Accordingly, the general objects of the present invention are to provide novel and improved methods and apparatus of such character.

(2.) Description of the Prior Art

While not limited thereto in its utility, the present invention is particularly well suited for use in the removal of waste edges from paper board blanks which are to subsequently be formed into boxes. As its well known, the blanks from which cardboard boxes are formed are punched from sheet material using steel line tools. The individual blanks, which are known as cutouts, together with the waste grid are stacked on pallets. The removal of the waste edge pieces from the stack is still frequently performed manually. This is an extremely laborious procedure which involves a high outlay of energy and time.

An example of prior apparatus which may be employed for the mechanical i.e., semi-automatic, removable of waste edges from punched blanks may be seen from published German patent application Ser. No. 2,283,184. This prior apparatus employs a plurality of milling cutters supported from a movable frame. In order to remove the waste edges, the frame is moved downwardly along the vertical side of a stack of punched blanks with the cutter positioned relative to the stack so as to engage the waste strips or edges. Prior apparatus of the type disclosed in German application No. 2,283,184 is characterized by a number of inherent deficiencies. Thus, by way of example, the milling cutters actually destroy the waste strips and, and in so doing, produce considerable dust and a high level of noise. Further, as a result of the relatively large diameter of the cutters themselves, the prior apparatus has limited utility, i.e., the prior apparatus can not be employed to remove very narrow waste strips. Furthermore, the forces exerted by the milling cutters of the prior apparatus are frequently insufficient to separate the waste edges from the blanks, this particularly being true in the case of cardboard having a smooth surface and a high gram weight. Additionally, the milling cutters have a comparatively short useful life and thus, when employing the prior apparatus, it is necessary to interrupt production at relatively short time intervals in order to change the cutters. It should also be noted that, since the cutters are driven at a very high speed, there is an inherent risk of injury to operating personnel.

SUMMARY OF THE INVENTION

The present invention overcomes the above-discussed and other deficiencies and disadvantages of the prior art by providing a novel and improved apparatus for removing waste edges from punched sheet material. The present invention also encompasses a novel technique for the removal of waste edge pieces from punched blanks. Apparatus in accordance with the present invention is less complicated and more reliable than previous available apparatus capable of performing the same function and is characterized by substantially dust free operation, greatly reduced noise level and minimal danger to operating personnel. Apparatus in accordance to present invention is further characterized by a high usage level, in that it can be used with virtually all work pieces regardless of the width of the waste strip, and by virtue of the fact that the maintenance requirements are minimal.

Apparatus in accordance with the present invention includes at least a first "parting" element, which engages and removes the waste strips, in the form of a pawl. This pawl is supported and driven such that its work engaging end, which is provided with teeth or serrations in an edge portion, will move about an orbital path. The pawl will engage a waste edge piece from above and part it from the blank during the retraction portion of its cycle of movement.

In accordance with a preferred embodiment of the present invention, a pair of identical "parting" elements, both of which are in the form of a toothed pawl, are driven by oppositely arranged eccentrics and are suspended from connecting rods which are articulated to a frame. The drive system causes the pawls to alternately act upon sucessively encounted waste edges as the frame is moved along a stack of punched blanks. Also in accordance with the perferred embodiment, the apparatus includes a guide bar which insures the proper spacing between the pawls and the blanks from which the waste edges are being removed.

The apparatus of the present invention insures the separation of waste edges pieces from cardboard box blanks and other types of blanks at a high rate. Since the engagement of the waste edges results from a puncturing action, specifically the linear penetration of the teeth of the pawl into the waste piece, the errosion associated with a cutting action is eliminated and the creation of dust avoided. This puncturing action is also relatively quiet. Further, the toothed pawls suffer very little wear and this enhances the efficiency of the apparatus through elimination of periodic repair operations and the down times associated therewith. Also, the risk of injury to operating personnel is minimized since the downwardly moving pawls, as opposed to the rapidly rotating cutters of the prior, will merely contact and knock downwardly a hand which is interadvertently placed in it path of the pawl. It is virtually impossible to insert a hand into the path of the toothed portion of the pawl during operation since the path of travel of the pawl is quite short and substantially entirely in alignment with the waste edge pieces.

BRIEF DESCRIPTION OF THE DRAWING

The present invention may be better understood and its numerous objects and advantages will become apparent to those skilled in the art by reference to the accompanying drawing wherein like reference numerals refer to like elements and in the several figures and in which.

DESCRIPTION OF THE DISCLOSED EMBODIMENTS

Figure 1:
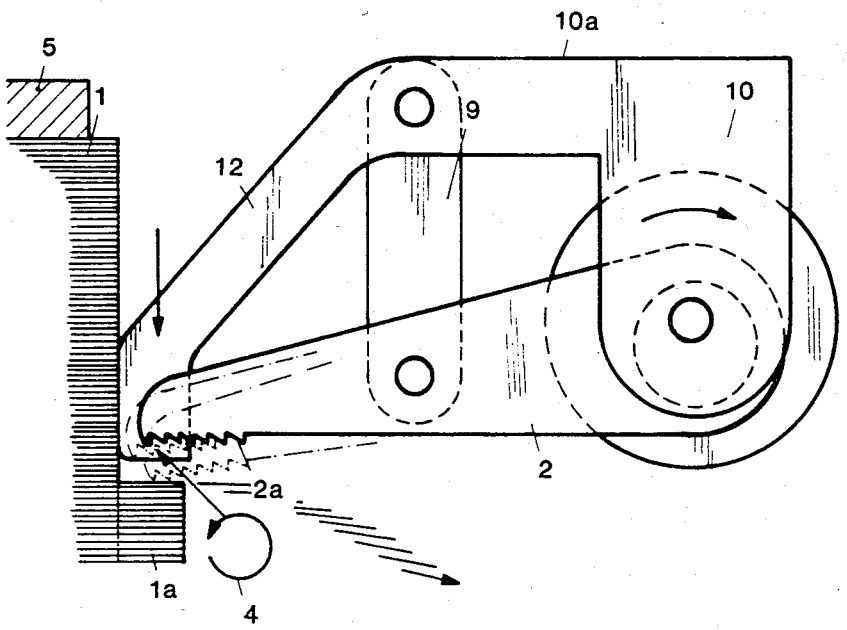
FIG. 1 is a schematic side elevation view of a first embodiment of apparatus in accordance with the present invention.

With reference now to FIG. 1, apparatus for removing waste edge pieces from punched blanks in accordance with the invention comprises a parting element 2 which is in the form of a toothed pawl 2. Pawl 2 is provided, along one edge extending inwardly from the free end thereof, with a row of teeth or serrations 2*a*. Orbital motion is imparted to pawl 2, in the manner to be described below, whereby the toothed portion thereof moves in the direction indicated by arrow 4. Thus, the teeth or serrations 2*a* descend downwardly to penetrate into the uppermost waste edge piece 1*a* of a stack 1 of punched blanks. Subsequently, as the pawl is retracted, the thus engaged waste edge piece will expelled to the right as the apparatus is depicted in FIG. 1. This action will start at the top of the stack and precede downwardly with the waste edge pieces being ejected from the sucessively encountered layers of the stack of punched blanks. If necessary to insure that a blank will not be pulled out of the stack along with its waste edge, the blanks are frictionally loaded against one and another, by means of a weight 5 or other force of applying member, which is placed in contact with the top of the stack.

Figure 2:
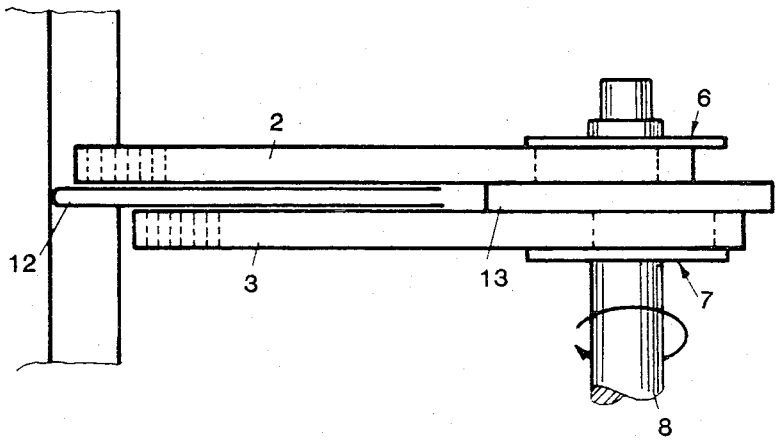
FIG. 2 is a schematic plan view of a second embodiment of apparatus in accordance with the present invention.

In order to enhance the speed of operation of the apparatus, and simultaneously reduce vibration and thus reduce noise, a pair of alternately operating parting elements maybe employed as depicted in FIG. 2. In the FIG. 2 apparatus the parting elements or pawls are indicated at 2 and 3, the pawls being respectively driven by eccentrics 6 and 7. The eccentrics 6 and 7 are oppositely disposed and defined a double eccentric drive which is coupled to a rotatable drive shaft 8.

Returning again to consideration of FIG. 1, the pawls are articulated, intermittent their length, to connecting rods, such as connecting rod 9. The connecting rods 9 suspend the pawls from a jib or extention 10*a* of a bearing housing 10. In the double pawl arrangement of FIG. 2 the bearing housing 10 will have a pair of jibs 10*a* and each pawl will be connected to a separate jib by means of a connecting rod 9. The double eccentric arrangement contributes to optimizming the balancing of the apparatus and thereby minimizing vibration and noise during the operation.

The embodiments of FIGS. 1 and 2 both employ a guide bar 12 which extends outwardly a predetermined distance past the point of maximum extention of the pawls. In the FIG. 1 embodiment the guide bar 12 comprises an extention of the jib 10*a*. In the FIG. 2 embodiment the guide bar 12 extends directly from the bearing housing 10. The nose or the leading edge of guide bar 12 will contact the edge of the stack 1 of blanks, as shown, during the downward movement of the apparatus. Accordingly, assuming the blanks have been correctly alined during the stacking, it is impossible for the pawls to contact and damage the blanks. The use of the guide bar 12 provides the additional advantage in that very small and precise clearance can be obtained and thus the present invention may be employed to remove very narrow waste edges from stamped blanks.

It may be desirable to mount a wheel 13, see FIG. 2, on the drive shaft 8 for the purpose of braking the waste edges which are thrown out by the retracting pawls. If such a braking wheel is employed, it will be provided with a suitable lining which cooperates with the waste edges which come in contact therewith.

Figure 3:
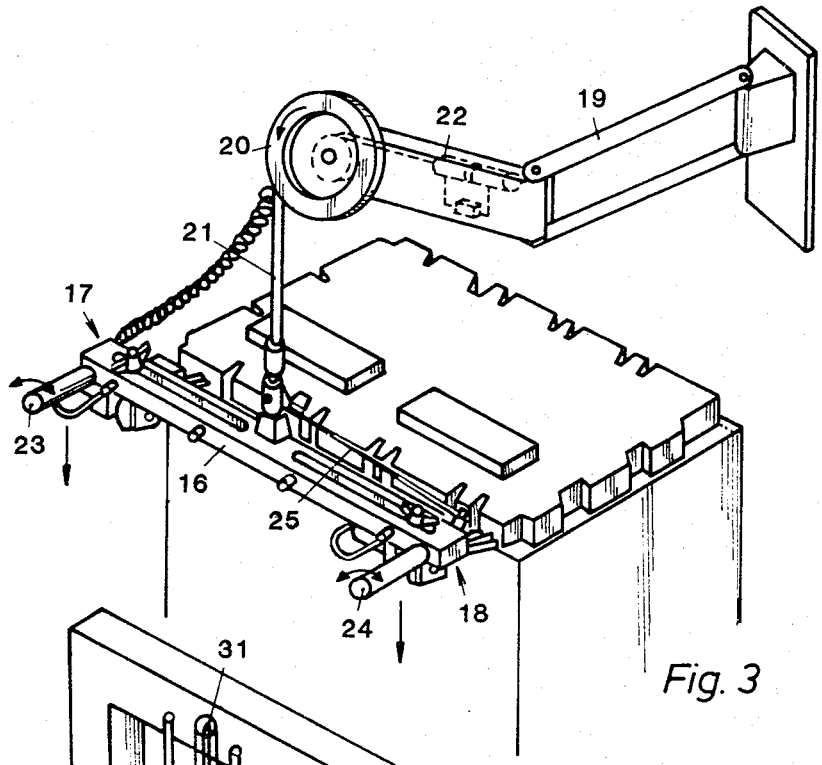
FIG. 3 is a isometric view of apparatus employing the embodiment of FIG. 2.

Referring now to FIG. 3, a manually actuated apparatus employing the parting mechanism in accordance with either of FIGS. 1 or 2 is shown. The apparatus depicted in FIG. 3 includes a floating frame 16 on which a pair of the parting elements, indicated generally at 17 and 18, are mounted. The spacing between the parting elements 17 and 18 is adjustable by means of sliding the elements in transverse slots in frame 16. A stationary double articulated jib 19 supports a drum 20. A traction element 21, which supports frame 16, may be wound on to and off of drum 20 through the use of a pneumatic servo drive which has been indicated at 22. The control of the servo drive 22, to cause upward movement of frame 16, is achieved by the use a handle 23. The frame 16 descends under the effect of gravity thus does not need to be driven downwardly. The speed of the motor which, through a drive shaft and eccentrics, drives the pawls is controlled by means of a second control handle 24, a control rod 25 connecting handle 24 with the motor speed control. The handles 23 and 24 are positioned so as to additionally function to manually guide frame 16 during the operation.

Figure 4:
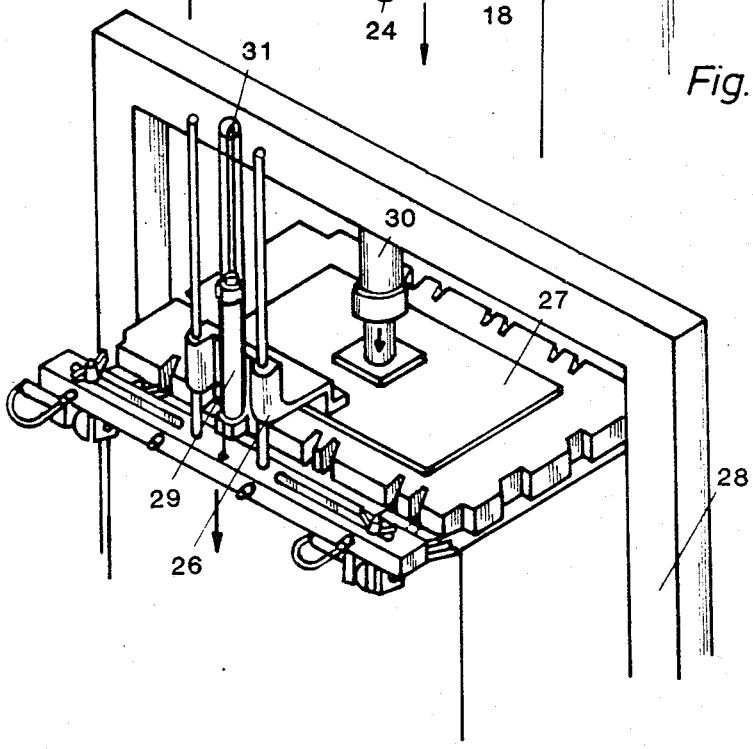
FIG. 4 is a perspective view of another apparatus employing the embodiment of FIG. 2.

FIG. 4 depictes a mechanism for automatically removing waste edges from a stack of punched blanks, i.e., in the FIG. 4 embodiment the control handles 23 and 24 have been eliminated and the parting elements are driven in both vertical directions. In FIG. 4 a vertical guide is indicated at 26. Guide 26 is an extention of a pressure plate 27 which is loaded against the top of the stack of blanks by means of a fluidic actuator 30. Actuator 30 is suspended from a frame 28 which bridges the stack of blanks. Vertical movement of the parting elements supporting frame is under the control of an actuator 29 which is connected, for example by a cable 31, to frame 28.

While perferred embodiments have been shown and described, various modifications and substitutions maybe made thereto without departing from the spirit and scope of the invention. Thus, by way of an example, more than two pawls can be used in a mechanism such as shown in FIG. 2 with the individual pawls operating on waste edges in consecutive fashion. Also, while the invention has been described in connection with the removal of waste edges from a single side of a punched blank, it will be obvious to those skilled in the art that apparatus in accordance with the invention may used to simultaneously operate on plural sides of a stack of blanks. Accordingly, it will understood that the present invention has been described by way of illustration and not limitation.

What is claimed is:

1. Apparatus for removing at least partly severed waste edges from sheet material which has been stacked comprising:

movable frame means;

at least a first parting element, said first parting element comprising an elongated arm having serrations in a first side edge adjacent a first end thereof;

means supporting said first parting element from said frame means; and means for imparting orbital movement to said first parting element first end whereby said serrated edge will contact and penetrate the waste edge of a sheet of material and then pull said waste edge outwardly with respect to the stack of sheets, said frame means being at least in part movable relative to said stack of sheets to cause said first parting element first end to consecutively engage a waste edge of adjacent sheets comprising the stack of sheets.

2. Apparatus for removing at least partly severed waste edges from sheet material which has been stacked comprising:

movable frame means;

a first parting element, said first parting element comprising an elongated arm having serrations in a first side edge adjacent a first end thereof;

at least a second parting element, said second parting element comprising an elongated arm having serrations in a first side edge adjacent a first end thereof;

means supporting said parting elements from said frame means; and means for imparting orbital movement to said parting element first ends, said movement imparting means being coupled to said parting elements so as to cause the movement of the arms thereof to be out-of-phase, said movement imparting means causing said serrated edges to contact and penetrate the sheet waste edges and to subsequently pull said waste edges outwardly with respect to the stack of sheets, said frame means being movable relative to said stack of sheets whereby said parting elements will alternately cause removal of the waste edge of a sheet comprising the stack of sheets, said waste edges thereby being consecutively removed from the sheets comprising the stack of sheets.

3. The apparatus of claim 2 where in said movement imparting means comprises:

a pair of oppositely arranged eccentric drives, said drives being coupled to respective of said first and second parting elements; and means for an imparting rotation to said eccentric drives.

4. The apparatus of claim 3 will be said frame means supports said eccentric drives and includes at least a first projection extending generally in the direction of operation of said parting elements, and said apparatus further comprising;

connecting rod means for supporting said parting elements intermediate their length from said frame means projection, said connecting rod mount being articulated to said parting elements.

5. The apparatus of claim 2 further comprising:

a guide bar, said guide bar being supported from said frame means, said guide bar extending in the direction of the operation of said parting elements a predetermined distance greater than the maximum extension of said parting elements, said guide bar having a nose portion which contacts the edges of sheets in the stack from which waste edges have been removed, said guide bar determining the minimum spacing between the said parting elements and the final edges of the sheets from which the waste edges are to be removed.

6. The apparatus of claim 3 further comprising:

a guide bar, said guide bar being supported from said frame means, said guide bar extending in the direction of the operation of said parting elements a predetermined distance greater than the maximum extension of said parting elements, said guide bar having a nose portion which contacts the edges of sheets in the stack from which waste edges have been removed, said guide bar determining the minimum spacing between the said parting elements and the final edges of the sheets from which the waste edges are to be removed.

7. The apparatus of claim 4 further comprising:

a guide bar, said guide bar being supported from said frame means, said guide bar extending in the direction of the operation of said parting elements a predetermined distance greater than the maximum extension of said parting elements, said guide bar having a nose portion which contacts the edges of sheets in the stack from which waste edges have been removed, said guide bar determining the minimum spacing between the said parting elements and the final edges of the sheets from which the waste edges are to be removed.

8. Apparatus for removing at least partly severed waste edges from sheet material which has been stacked comprising:

movable frame means;

at least a first parting element, said first parting element comprising an elongated arm having serrations in a first side edge adjacent a first end thereof;

means supporting said first parting element from said frame means:

means for imparting orbital movement to said first parting element first end whereby said serrated edge will contact and penetate the waste edge of a sheet of material and then pull said waste edge outwardly with respect to the stack of sheets, said frame means being at least in part movable relative to said stack of sheets to cause said first parting element first end to consecutively engage a waste edge of adjacent sheets comprising the stack of sheets; and a guide bar, said guide bar being supported from said frame means, said guide bar extending in the direction of the operation of said parting element a predetermined distance greater than the maximum extension of said parting elements, said guide bar having a nose portion which contacts the edges of sheets in the stack from which waste edges have been removed, said guide bar determining the minimum spacing between the said first parting elements and the final edges of the sheets from which the waste edges are to be removed.

9. The apparatus of claim 1 further comprising:

braking means; and means rotatably mounting said braking means in the path of movement of the waste edges removed from the sheets of material whereby said braking means will contact said removed waste edges and retard the movement thereof away from the stack of sheets.

10. The apparatus of claim 2 further comprising:

braking means; and means rotatably mounting said braking means in the path of movement of the waste edges removed from the sheets of material whereby said braking means will contact said removed waste edges and retard the movement thereof away from the stack of sheets.

11. The apparatus of claim 8 further comprising:

braking means; and means rotatably mounting said braking means in the path of movement of the waste edges removed from the sheets of material whereby said braking means will contact said removed waste edges and retard the movement thereof away from the stack of sheets.

12. The apparatus of claim 2 wherein said frame means comprises:

a floatingly suspended frame, said parting elements being suspended from said frame; and traction means for moving said frame in at least a first direction.

13. Apparatus according to claim 12 wherein said traction means is mounted at the end of a stationary articulated jib.

* * * * *

UNITED STATES PATENT AND TRADEMARK OFFICE

CERTIFICATE OF CORRECTION

PATENT NO. : 4,537,589

DATED : August 27, 1985

INVENTOR(S) : Heinrich Schmidt

It is certified that error appears in the above-identified patent and that said Letters Patent is hereby corrected as shown below:

Claim 8, Line 9 (Column 6, Line 25), change the ":" to --;--

Claim 8, Line 22 (Column 6, Line 38), after "said" insert -first-

Claim 8, Line 24 (Column 6, Line 40), change "parting elements" to -first parting element- Claim 8, Line 28 (Column 6, Line 44), cancel "the"

Claim 8, Line 29 (Column 6, Line 45), change "ments" to -ment first end-

Signed and Sealed this

*Second* Day of *September 1986*

[SEAL]

*Attest:*

DONALD J. QUIGG

*Attesting Officer*

*Commissioner of Patents and Trademarks*